US011311991B2

(12) United States Patent
Kobus et al.

(10) Patent No.: US 11,311,991 B2
(45) Date of Patent: Apr. 26, 2022

(54) OIL FILTER REMOVAL TOOL

(71) Applicants: Michael Kobus, Baltimore, MD (US); Anna Kobus, Baltimore, MD (US)

(72) Inventors: Michael Kobus, Baltimore, MD (US); Anna Kobus, Baltimore, MD (US)

( * ) Notice: Subject to any disclaimer, the term of this patent is extended or adjusted under 35 U.S.C. 154(b) by 553 days.

(21) Appl. No.: 16/287,030

(22) Filed: Feb. 27, 2019

(65) Prior Publication Data

US 2019/0262980 A1 Aug. 29, 2019

Related U.S. Application Data

(60) Provisional application No. 62/635,910, filed on Feb. 27, 2018.

(51) Int. Cl.
*B25B 27/00* (2006.01)

(52) U.S. Cl.
CPC ..... *B25B 27/0042* (2013.01)

(58) Field of Classification Search
None
See application file for complete search history.

(56) References Cited

U.S. PATENT DOCUMENTS 3,910,140 A * 10/1975 Rose ..... B25B 13/18 81/91.3
5,307,712 A * 5/1994 Pratt ..... B25B 27/0042 81/120
5,458,027 A * 10/1995 Rambin ..... B25B 13/52 81/3.43
5,845,550 A * 12/1998 Edwards ..... B25B 13/52 81/65
6,227,078 B1 5/2001 Lemmo, Jr.
2014/0144297 A1 5/2014 Antonio

OTHER PUBLICATIONS

K&N 1" Nut Premium Wrench-Off Oil Filter, https://www.suprastore.com/kn1nutprwroi.html.
Heavy Duty Billet BMW Oil Filter Cap Removal/Install Tool, http://www.burgertuning.com/billet_bmw_oil_filter_wrench_removal_install_tool.html.
Motivx Tools Toyota & Lexus Oil Filter Wrench for 2.5L to 5.7L Engines, https://www.amazon.com/Motivx-Tools-Toyota-Filter-Engines/dp/B00XTAGHU0/ref=sr_1_12?ie=UTF8&qid=1518127107&sr=8-12&keywords=oil+filter+wrench.

* cited by examiner

*Primary Examiner* — Brian D Keller
(74) *Attorney, Agent, or Firm* — The Iwashko Law firm, PLLC; Lev Ivan Gabriel Iwashko

(57) ABSTRACT

An oil filter removal tool used for removing seized filters from internal combustion engines. Additionally, the oil filer removal tool is designed to provide various method of applying a torque to an oil filter. To achieve this the tool has a gripper mechanism, a tool engagement mechanism, an annular clamp, and a plurality of protective covers. The gripper mechanism is able to grasp onto the oil filter. Additionally, the tool engagement mechanism is permanently integrated onto the gripper mechanism. This enables the user to apply a higher torque to the oil filter housing, thus removing even seized filters without damaging the oil filter itself. Similarly, the plurality of protective covers is positioned between the gripper mechanism and the oil filter to provide an additional layer of protection, if the user chooses to install the oil filter removal tool onto the new filter for the next oil change.

8 Claims, 9 Drawing Sheets

OIL FILTER REMOVAL TOOL

The current application claims a priority to the U.S. Provisional Patent application Ser. No. 62/635,910 filed on Feb. 27, 2018.

FIELD OF THE INVENTION

The present invention generally relates to hand tools. More specifically the present invention is an oil-filter removal tool, designed to aid users in removing the oil filters commonly used in internal combustion engines.

BACKGROUND OF THE INVENTION

Human development has been centered around the production and use of energy. Access to fossil fuels and electrical power lay the foundation for the world as we see it today. Some common examples include petroleum, coal and natural gas. Numerous derivatives can be refined from fossil fueled based energy sources. Some common examples include gasoline, diesel or kerosene. The internal combustion engine is by far the most popular options when it comes to powering modern transportation vehicles.

Internal combustion engines require lubrification for proper operation, and as result most engines have dedicated systems that supply the moving parts with oil during operation. The lubrification system not only reduces friction between components, but also helps control the overall operating temperature. The engine lubrification system varies depending on the design and scale of the engine, however the basic components and principles remain largely unchanged. Typically, most internal combustion engines comprise an oil pump, an intake, a sump, and a filter. Furthermore, consistent maintenance is required at specific time intervals to ensure the mechanical components of the engine are kept in the best possible condition. Oil degrades over time therefore an oil change is a common service performed on modern engines. The typical oil change service, requires draining the old oil, replacing the oil filter and refiling the engine with new oil to the appropriate level indicated by the manufacturer. Failure to do consistent oil changes can result in catastrophic failure of mechanical components, and costly repairs.

Each vehicle manufacturer has their own specification about the type of oil, and oil filter used in the engine. Numerous types of oils have been developed each designed to meet specific characteristics, and climate conditions. Furthermore, oil filters come in different shapes, sizes and designs, depending on the type of engine. Cartridge and spin-on type filters are some of the most common types used in modern engines. In the cartridge style filter, the permanent housing is mounted directly on the engine or in a separate offset location. The user can replace the filter element directly into the housing. In the spin-on type filters, the filtration medium is encapsulated into an individual housing. In addition, a fastening method is also integrated into the filter allowing the assembly to bold on directly to the engine. In order to remove the assembly, the user must unbolt the filter from the engine. Problems arise when the filter is fixated to the bolt, and threads are seized. Due to the numerous heat cycles to which the components are exposed, the metal contracts and expands, and as such it is not uncommon for filters to seize on the threads, making them extremely difficult to remove. Due to the positioning of said filters, often times, the user must crawl underneath a suspended vehicle and unbolt a filter by hand, using various tools that create an unpleasant working environment where used motor oil is spilled onto the user.

People that take the liberty to service their own vehicles, are faced with challenges when attempting to replace oil filters that are seized on the engine. The process can be tedious and miserable, requiring the user to place themselves in twisted or awkward positions to access the filters. Traditional tools available for this process are not user friendly and often times they do no work as advertised. In addition, in numerous cases due to the compact design of the engine bay, traditional tools may not be used due to space constraints. Furthermore, a common method of removing a seized oil filter is by using a blunt object such as a screwdriver and hammering it through the oil filter housing directly, creating a messy working environment, and an unpleasant experience. The present invention includes, a female socket adapter integrated into the canister of the self-contained oil filter, allowing the user to apply a torque to the filter using a standardized ratchet, preventing slippage. The present invention is versatile and may be used with filters of various shapes and sizes. Furthermore, the present invention may be installed on the replacement oil filter, securing the tool to the vehicle until the next oil change.

DETAIL DESCRIPTIONS OF THE INVENTION

All illustrations of the drawings are for the purpose of describing selected versions of the present invention and are not intended to limit the scope of the present invention.

The present invention includes an oil filter removal tool, which is a device that is used for removing oil filters. Preferably, the term oil filter is used herein to refer to any device which filters the oil in an internal combustion engine. Traditional internal combustion engines regardless of the type of fuel uses rely on lubrification for functionality.

Therefore, most engines have an integrated lubrification system that use various forms of oil, which is circulated through the engine, and the respective filter. The present invention is an oil filter removal tool that is designed to facilitate the removal of a seized oil filter, while still maintaining the overall integrity of the filter housing.

Figure 1:
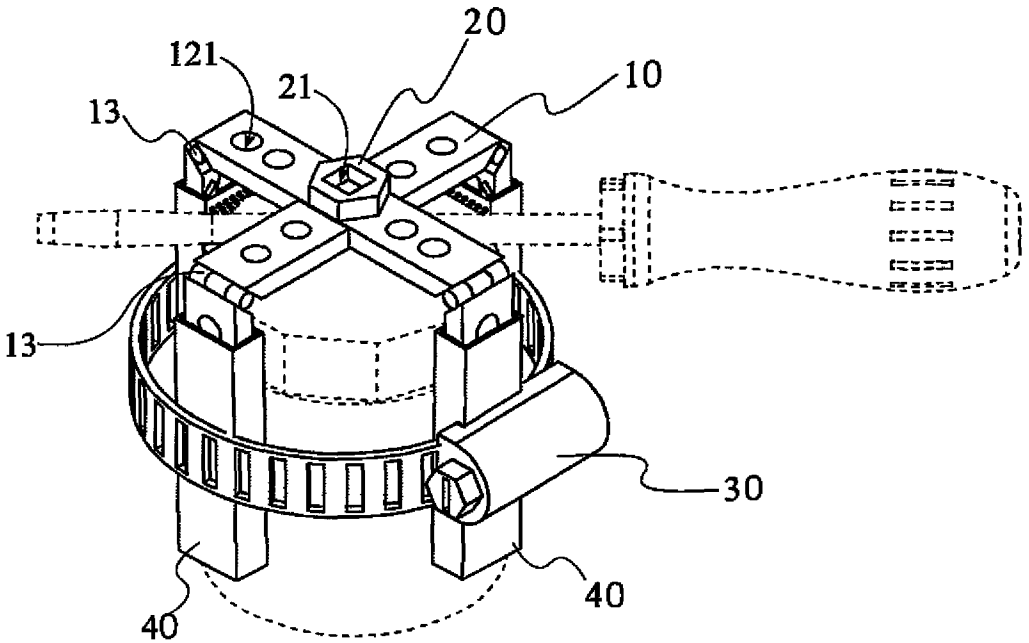
FIG. 1 is a top perspective view of the present invention with a hand tool attached.
Figure 2:
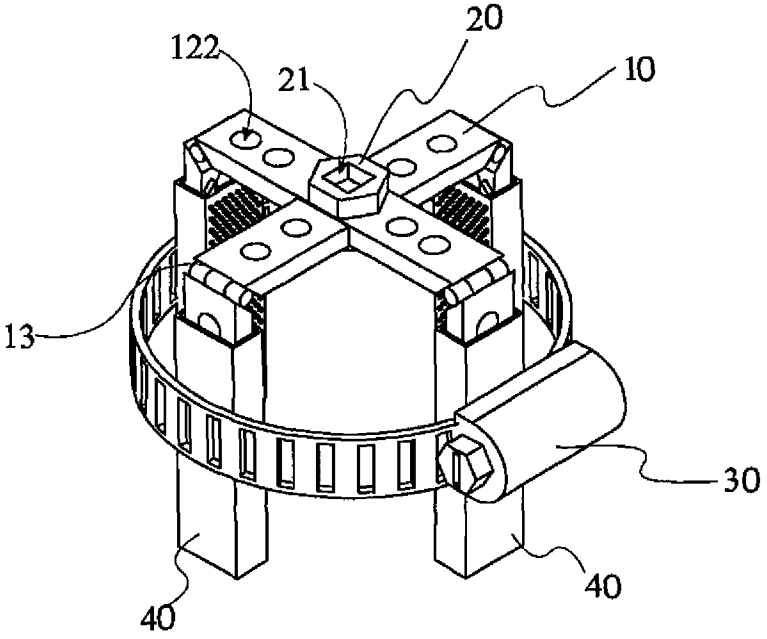
FIG. 2 is an isometric perspective view of the present invention.
Figure 3:
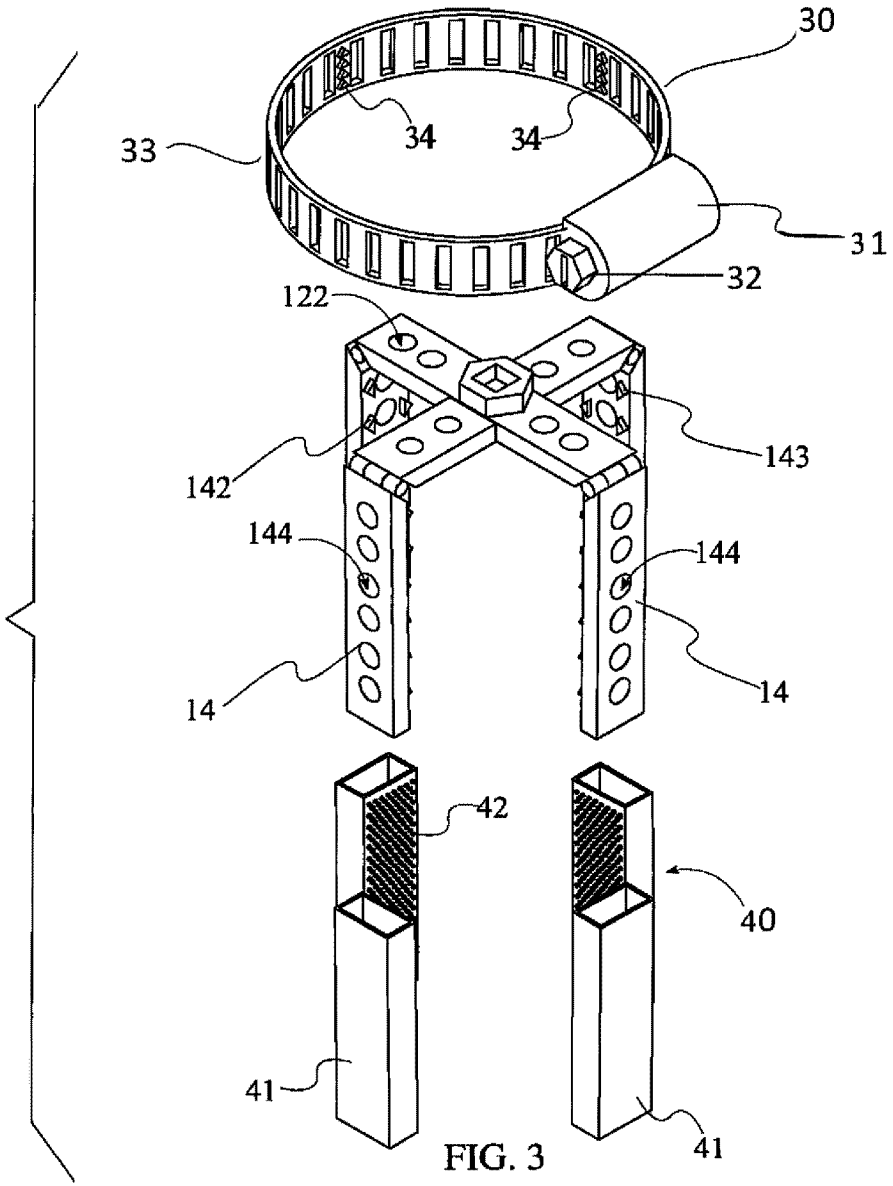
FIG. 3 is a top exploded view of the present invention.

In reference to FIGS. 1-3 to achieve the above-mentioned functionality, the present invention comprises a gripper mechanism 10, a tool engagement mechanism 20, and a continuous annular clamp 30. The gripper mechanism 10 functions as a claw to grasp the oil filter and transfer the torque from the hand tool attached through the tool engagement mechanism 20. The gripper mechanism 10 comprises a crossmember brace 12, a plurality of articulated connectors 13, and a plurality of singular contiguous compression brackets 14. Each of the plurality of articulated connectors 13 is connected in between the crossmember brace 12 and a corresponding bracket from the plurality of compression brackets 14. The plurality of articulated connectors 13 allow the compression brackets 14 to pivot inwards and outwards as referenced in FIG. 4. As a result, the gripper mechanism 10 is able to grasp oil filters of various sizes. In addition, the gripper mechanism 10 may be positioned at various points along the oil filter housing, depending on the individual design of the internal combustion engine.

Figure 4:
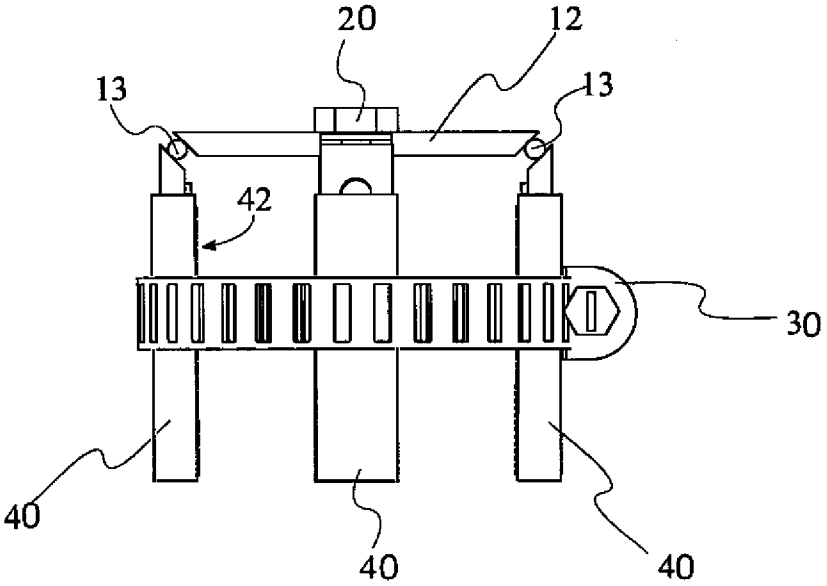
FIG. 4 is a front view of the present invention.
Figure 5:
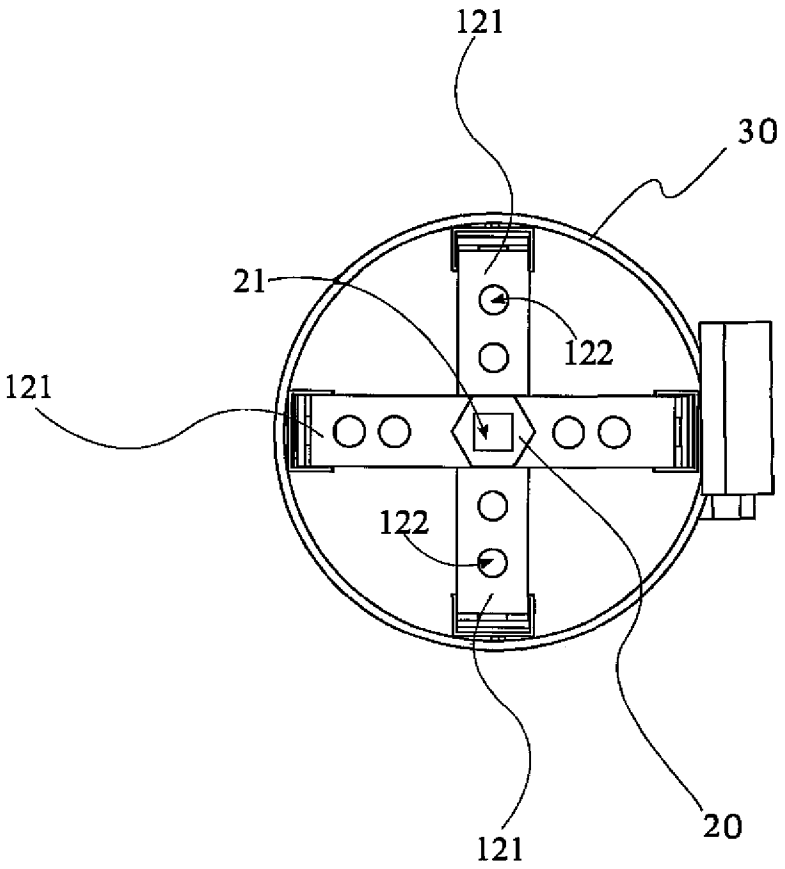
FIG. 5 is a top view of the present invention.

In reference to FIG. 4, the plurality of compression brackets 14 is radially distributed about the crossmember brace 12. Therefore, the plurality of compression brackets 13 provide multiple contact points, where the gripper mechanism 10 can secure the oil filter. The tool engagement mechanism 20 is mounted adjacent to the crossmember brace 12. As a result, the tool engagement mechanism 20 serves as the dedicated coupling point between a tool and the present invention. In reference to FIG. 3, the tool engagement mechanism 20 and the annular clamp 30 are colinearly aligned along a rotation axis of the gripper mechanism 10. The annular clamp 30 sleeves the gripper mechanism 10. As a result, the gripper mechanism 10 is secured to the oil filter housing, preventing slippage. Furthermore, when the user applies a torque to the present invention using the tool engagement mechanism 20, the gripper mechanism 10 is able to transfer the rotational forces to the oil filter housing. The articulated connector 13 is a spring hinge. However, various other type of hinges may be used including but not limited to, pivotal hinges, and rotating hinges.

Figure 9:
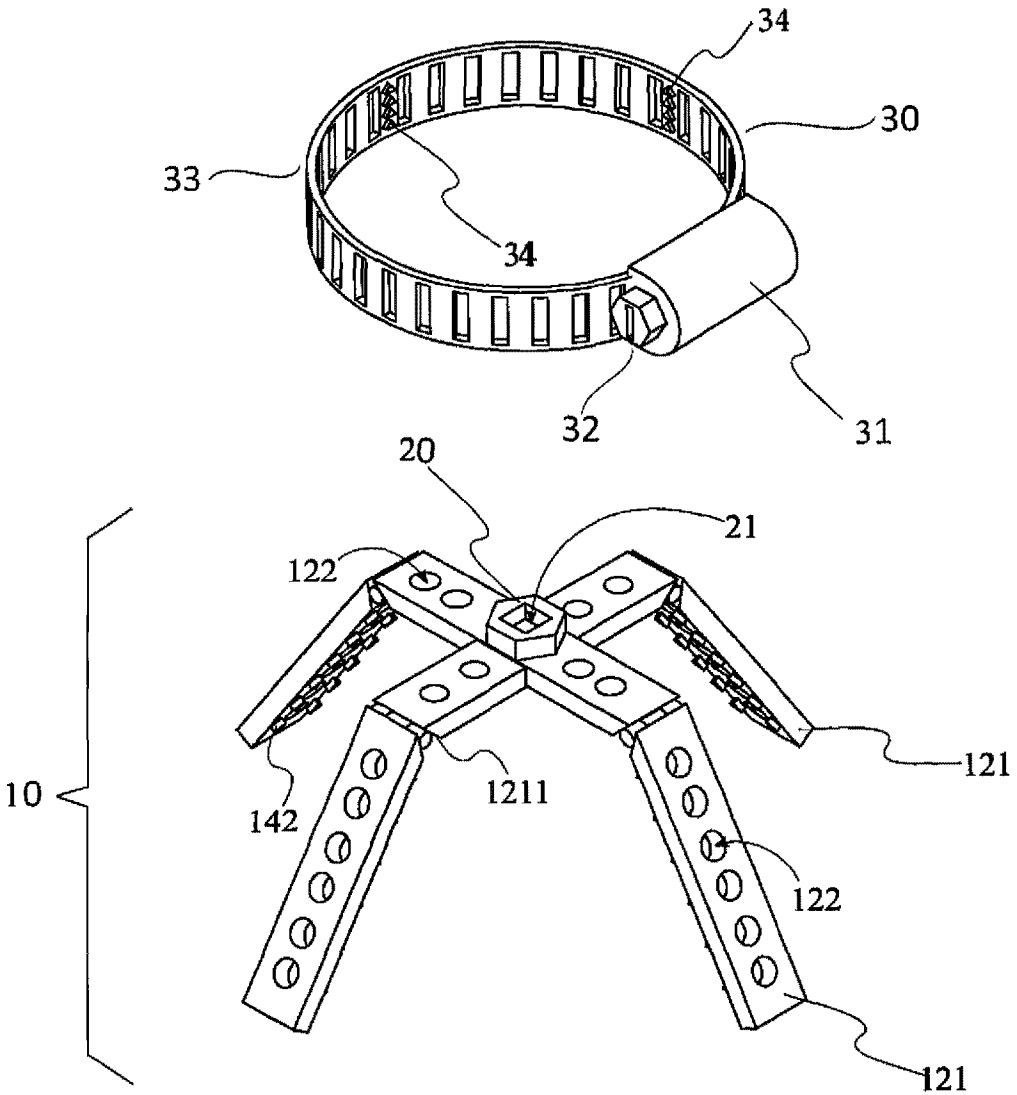
FIG. 9 is a top exploded perspective view of the present invention, with the gripper mechanism flared out.

In reference to FIG. 3 and FIG. 9 each of the plurality of compression brackets 14 comprises a bracket body 141, a first plurality of engagement teeth 142 and a second plurality of engagement teeth 143. Each of the plurality of engagement teeth, allow the user to transfer the torque applied to the present invention, and more effectively grasp and remove the oil filter. The first plurality of engagement teeth 141 is connected adjacent to a compression face of the bracket body 141. The first plurality of engagement teeth 141 is serially distributed along a first lengthwise edge 1412 of the bracket body 141. The second plurality of engagement teeth 143 is connected adjacent to a compression face 1411 of the bracket body 141. The second plurality of engagement teeth 143 is positioned offset from the first plurality of engagement teeth 142, across the bracket body 141. The second plurality of engagement teeth 143 is serially distributed along a second lengthwise edge 1413 of the bracket body. As a result, the first plurality of engagement teeth 142, and the second plurality of engagement teeth 143 are oppositely positioned from each other.

A toothed edge 142 of each of the plurality of engagement teeth is oriented toward the first lengthwise edge 1412. A toothed edge 142 of each of the second plurality of engagement teeth 143 is oriented towards the second lengthwise edge 1413. In the preferred embodiment, the first plurality of engagement teeth 142 is oriented in the clockwise direction. As a result, the first plurality of engagement teeth 142, and the second plurality of engagement teeth 143 grip onto the oil filter when the user applies a clockwise rotational force to the tool engagement mechanism 20, reducing the possibility of slippage between the present invention and the oil filter. Furthermore, the second plurality of engagement teeth 143 is oriented in a counterclockwise direction. Traditionally, oil filters rely on threaded connections for attachment to the engine block. To remove an existing oil filter, a counterclockwise rotational force must be applied to the filter body. The second plurality of engagement teeth 143 is oriented in the counterclockwise direction. As a result, the second toothed edge 1431 of the second plurality of engagement teeth 142, is able to effectively transfer the rotational forces while keeping the present invention secured to the oil filter housing.

In reference to FIG. 4 each of the plurality of compression brackets 14 further comprise a plurality of holes 144. The plurality of holes 144 transverses normally through the bracket body 141. As a result, the plurality of holes 144 allow a user to slide a tool, through the plurality of holes 144 and apply a torque through the tool handle. A common method of removing a seized oil filter is to hammer a screwdriver through the housing of the oil filter. The plurality of holes 144 provide a similar method of applying a torque to the oil filter, without the need to pierce the housing of the filter. The user can slide the tool through the plurality of holes 144, and as a result the housing of the oil filter remains intact, maintaining a clean working space. The plurality of holes 144 is distributed along the bracket body. The plurality of holes 144 is positioned in between the first plurality of engagement teeth 142 and the second plurality of engagement teeth 143. A screwdriver is a common example of a type of tool that is usually used to remove an oil filter, as referenced in FIG. 1.

In reference to FIGS. 2-3, the present invention further comprises a plurality of protective covers 40. Each of the plurality of plurality of compression brackets 14 engage into a corresponding cover from the plurality of protective covers 40. The present invention may also be used to secure a new oil filter to the appropriate torque. In some cases, if a new oil filter is not tightened to the torque indicated by the manufacturer, oil leaks may occur. When the plurality of protective covers 40 are in place, the user ensures that the first plurality of engagement teeth 142, and the second plurality of engagement teeth 143 is not damaging the housing of the new oil filter. Each of the plurality of protective covers 40 comprises a cover body 41 and a textured surface 42. The cover body 41 encapsulates a respective compression bracket 14 from the plurality of compression brackets 14. The textured surfaced 42 is laterally integrated into the cover body 41. The textured surface 42 enhances the grip between the cover body 41 and the surface of the oil filter.

Figure 6:
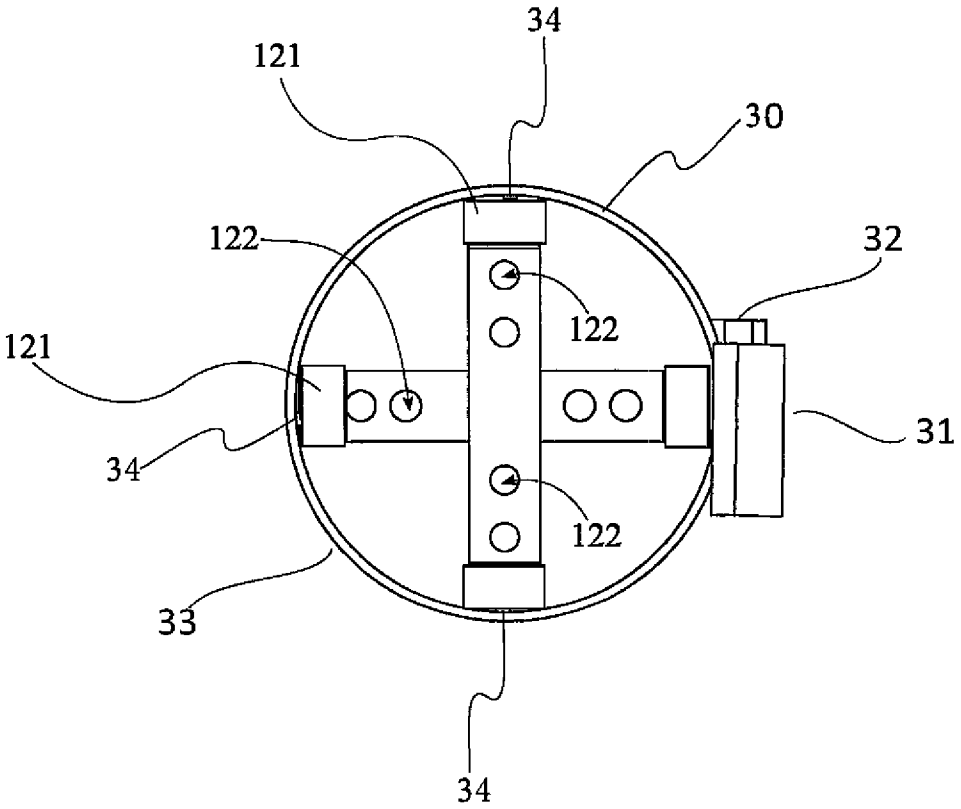
FIG. 6 is a bottom view of the present invention.

In reference to FIG. 6, the crossmember brace 12 comprises a plurality of interconnecting arms 121. A first end 1211 of each of the plurality of interconnecting arms 121 is adjacently connected to the tool engagement mechanism 20. The crossmember brace 12 provides a necessary support frame for the tool engagement mechanism 20 to rotate the gripper mechanism when the torque is applied through the tool engagement mechanism 20. The plurality of interconnecting arms 121 is radially distributed around the rotation axis. Each of the plurality of articulated connectors 13 is adjacently connected to a second end 1212 of a corresponding arm from the plurality of interconnecting arms 121.

Figure 7:
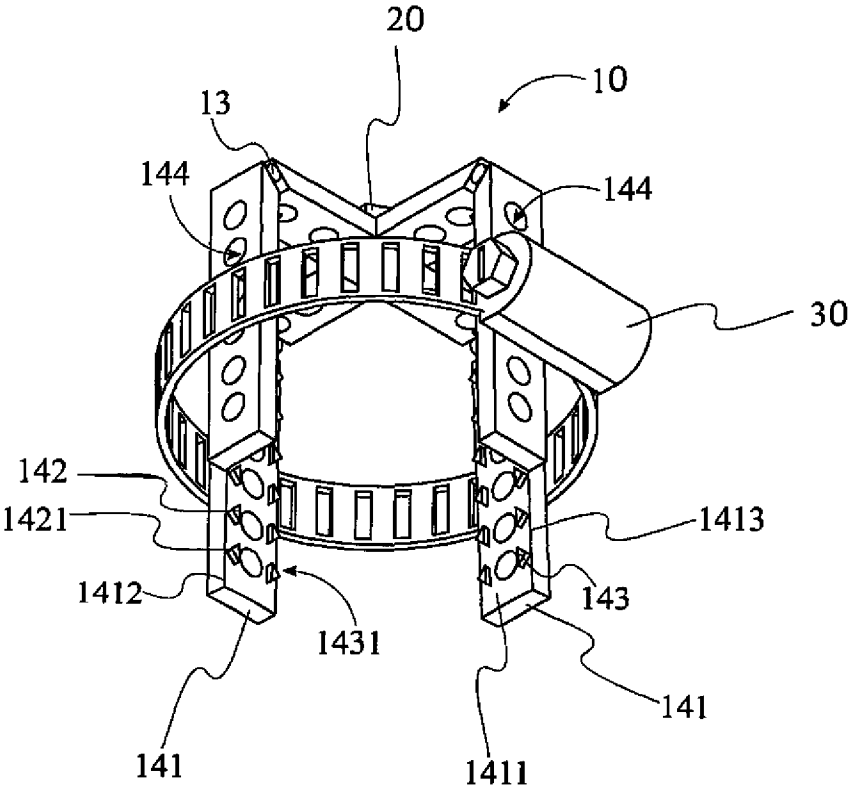
FIG. 7 is a bottom perspective view of the present invention.
Figure 8:
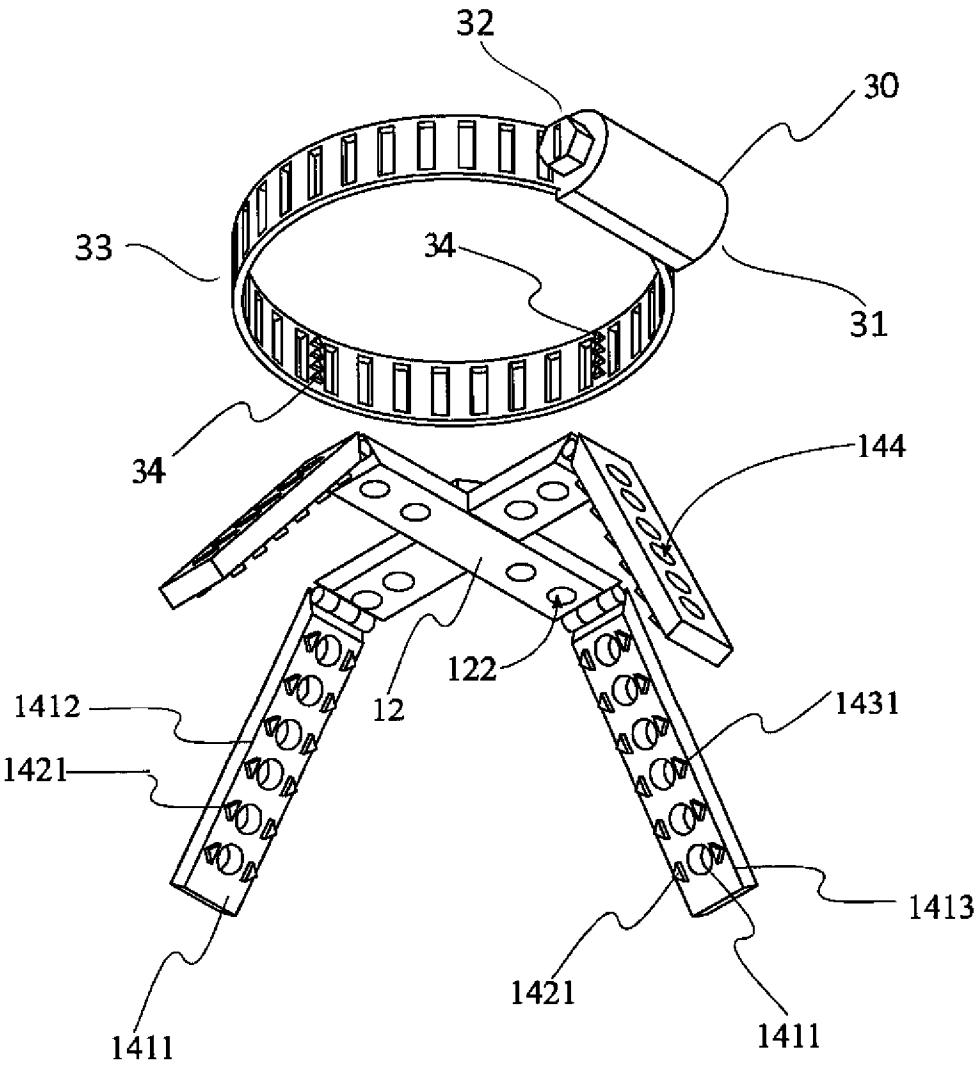
FIG. 8 is an exploded bottom perspective view of the present invention, with the gripper mechanism flared out.

In reference to FIG. 6 and FIG. 7, the crossmember brace 12 further comprises a plurality of crossmember holes 121. The plurality of crossmember holes 121 traversing through each of the plurality of interconnecting arms 121. As an example, the user may choose to insert fasteners through the plurality of crossmember holes 121, securing the crossmember brace 12 to the oil filter. By temporality attaching the crossmember brace 12 directly to the oil filter, the present invention ensures the torque applied by the user is transferred effectively to the oil filter housing, eliminating the possibility of slippage.

In reference to FIG. 6 the present invention further comprises a tool-receiving receptacle 21. The tool receiving receptacle 21 normally traverses into the tool engagement mechanism 2. In the preferred embodiment, the tool receiving receptacle 21 is designed to receive a traditional ratchet wrench, a socket, an open-end wrench, or a variation of these. The tool engagement mechanism 20 is permanently attached to the crossmember brace 12. While in most instances a hand tool would allow the user to apply the sufficient torque for removal of the oil filter, in some cases the user may choose to use a pneumatic or electrically powered tool to apply the torque. As a result, the tool receiving receptacle 21 may be adapted to fit various standardized sizes. The torque tool secures normally into the tool-receiving receptacle 21, allowing the user to transfer the torque applied to the body of the tool into a rotational motion. The tool-receiving receptacle 21 is colinearly aligned along the rotation axis. Consequently, the tool-receiving receptacle 21 provides a balanced rotation of motion distributing the torque equidistantly through the gripper mechanism 10.

In reference to FIGS. 3, 6, 8, and 9 the annular clamp 30 may include a housing 31, a band tightening member 32, a band 33, and a plurality of clamp teeth 34. The annular clamp 30 sleeves the gripper mechanism 10, applying a concentric constricting force to the plurality of interconnecting arms 121. Specifically, the housing 31 may be connected to the band tightening member 32 and the band 33, such that a turning of the band tightening member 32 in a first direction constricts the band 33 (i.e., makes the band 33 have a smaller circumference, and a turning of the band tightening member 32 in a second direction expands the band 33 (i.e., makes the band 33 have a larger circumference). Therefore, as the band 33 constricts, the plurality of compression brackets 14 pivot inward to allow the compression brackets 14 to grip the oil filter. The plurality of clamp teeth 34 is laterally connected to the annular clamp 30. As a result, the plurality of clamp teeth 34 secure the annular clamp 30 to the gripper mechanism 10. The plurality of clamp teeth 34 being positioned in between the annular clamp 30 and the plurality of compression brackets 14. The plurality of clamp teeth 34 further secure the present invention to the oil filter housing. Consequently, the annular clamp 30 allows user to secure the present invention to the new oil filter until the next oil change. As a result, the possibility of potentially losing the tool is decreased.

Although the invention has been explained in relation to its preferred embodiment, it is to be understood that many other possible modifications and variations can be made without departing from the spirit and scope of the invention as hereinafter claimed.

What is claimed is:

1. An oil filter removal tool to remove an oil filter, the oil filter removal tool comprising:

a gripper mechanism to attach to the oil filter, the gripper mechanism comprising:

a singular contiguous interconnecting arm to be disposed substantially parallel to a top surface of the oil filter, another interconnecting arm disposed perpendicular with respect to the singular contiguous interconnecting arm, and a plurality of singular contiguous compression brackets each hingedly connected directly to a respective end of the singular contiguous interconnecting arm or the another interconnecting arm to contact side portions of the oil filter; and a continuous annular clamp connected to each of the plurality of singular contiguous compression brackets to cause the plurality of singular contiguous compression brackets to pivot inward toward the oil filter.

2. The oil filter removal tool of claim 1, wherein the continuous annular clamp comprises:

a housing; and a band connected to the housing to expand and constrict based on a user's preference.

3. The oil filter removal tool of claim 2, wherein the continuous annular clamp further comprises:

a band tightening member to allow the user to expand the band by turning the band tightening member in a first direction, and to allow the user to constrict the band by turning the band tightening member in a second direction.

4. The oil filter removal tool of claim 3, wherein an inner surface of the band contacts outer surfaces of each of the plurality of singular contiguous compression brackets to cause each of the plurality of singular contiguous compression brackets to pivot inward in response to the band being constricted.

5. The oil filter removal tool of claim 4, further comprising:

at least one protective cover to cover at least a portion of at least one of the singular contiguous compression brackets.

6. The oil filter removal tool of claim 1, further comprising:

at least one protective cover to cover at least a portion of at least one of the singular contiguous compression brackets.

7. The oil filter removal tool of claim 6, wherein at least a portion of the at least one protective cover is to be disposed between the at least one singular contiguous compression bracket and the side portion of the oil filter.

8. The oil filter removal tool of claim 1, further comprising:

a tool engagement mechanism connected to the gripper mechanism to transfer torque applied to the tool engagement mechanism to the gripper mechanism to facilitate removal of the oil filter.

* * * * *